US009694292B2

(12) United States Patent
Rebbie et al.

(10) Patent No.: US 9,694,292 B2
(45) Date of Patent: Jul. 4, 2017

(54) AMUSEMENT RIDE TRANSFER ACCESSIBILITY DEVICE FOR THE PHYSICALLY-DISABLED

(71) Applicant: Philadelphia Toboggan Coasters, Inc., Hatfield, PA (US)

(72) Inventors: Thomas D. Rebbie, Quakertown, PA (US); Philip A. Zirkelbach, Pennsburg, PA (US); Richard W. Snyder, Quakertown, PA (US); Torrence V. Jenkins, Jr., Denver, PA (US)

(73) Assignee: Philadelphia Toboggan Coasters, Inc., Hatfield, PA (US)

( * ) Notice: Subject to any disclaimer, the term of this patent is extended or adjusted under 35 U.S.C. 154(b) by 0 days.

(21) Appl. No.: 15/085,248

(22) Filed: Mar. 30, 2016

(65) Prior Publication Data

US 2016/0296390 A1 Oct. 13, 2016

Related U.S. Application Data

(60) Provisional application No. 62/145,209, filed on Apr. 9, 2015.

(51) Int. Cl.
*A63C 17/00* (2006.01)
*A63G 7/00* (2006.01)
(Continued)

(52) U.S. Cl.
CPC ..... *A63G 7/00* (2013.01); *A61G 3/063* (2013.01); *A61G 7/1001* (2013.01); *A61G 7/109* (2013.01);
(Continued)

(58) Field of Classification Search
CPC ..... A61G 3/02; A61G 3/0209; A61G 3/0218; A61G 3/0236; A61G 3/0245; A61G 3/06; A61G 3/062; A61G 3/068
See application file for complete search history.

(56) References Cited

U.S. PATENT DOCUMENTS 3,997,213 A * 12/1976 Smith ..... A47C 4/28 280/30
5,584,082 A 12/1996 Crawford et al.
8,544,866 B2 * 10/2013 Noonan ..... A61G 5/006 280/304.1

FOREIGN PATENT DOCUMENTS

JP 2000232994 8/2000
JP 2002126004 5/2002
JP 2014019212 2/2014

OTHER PUBLICATIONS

International Search Report for corresponding PCT Application No. PCT/US2016/025191 dated Jun. 29, 2016.

* cited by examiner

*Primary Examiner* — Erez Gurari
(74) *Attorney, Agent, or Firm* — Caesar Rivise, PC

(57) ABSTRACT

An apparatus and method for assisting the transfer of a physically-disabled person into or out of an amusement ride. The apparatus and method involve a base portion having an elevated seat and an associated extension. The base portion is mobile and can be positioned adjacent the amusement ride. The extension is then positioned within the amusement ride to provide a smooth platform that permits the passenger to slide from the elevated seat, down the extension and into an open seat in the amusement ride. The process is reversed to permit the passenger egress from the amusement ride. The base portion also includes at least one wheel assembly and feet upon which the base portion rests during use. When it is necessary to move the base portion, it is simply tilted onto the wheel assembly off of the feet for quick and easy transport. The elevated seat and extension are covered with a comfortable material.

20 Claims, 8 Drawing Sheets

(51) Int. Cl.

| | |
|---|---|
| ***A61G 3/06*** | (2006.01) |
| ***A61G 7/10*** | (2006.01) |
| ***A63G 4/00*** | (2006.01) |

(52) U.S. Cl.

CPC ..... *A61G 7/1025* (2013.01); *A61G 7/1046* (2013.01); *A61G 7/1086* (2013.01); *A63G 4/00* (2013.01); *A61G 7/1059* (2013.01)

AMUSEMENT RIDE TRANSFER ACCESSIBILITY DEVICE FOR THE PHYSICALLY-DISABLED

CROSS-REFERENCE TO RELATED APPLICATIONS

This non-provisional application claims the benefit under 35 U.S.C. §119(e) of Application Serial No. 62/145,209 filed on Apr. 9, 2015 entitled AMUSEMENT TRANSFER ACCESSIBILITY DEVICE FOR THE PHYSICALLY-DISABLED and whose entire disclosure is incorporated by reference herein.

BACKGROUND OF THE INVENTION

The present invention relates generally to amusement rides and, more particularly, to a device and method for permitting a physically-disabled person to more easily enter as well as exit an amusement ride.

Amusement rides, such a roller coasters by way of example only, comprise vehicles or cars that typically are situated at the passenger entry/egress platform having a floor that is lower than the platform. A typical passenger can step through an opening in the amusement ride side and down onto the ride floor and then be easily seated on the ride seat. However, for a physically-disabled person, especially one that is wheelchair-bound, exiting the wheelchair to enter the amusement ride, or conversely, exiting the amusement ride, can be a very difficult and hazardous maneuver.

Thus, there remains a need for an accessibility or transfer device that can be easily maneuvered next to an amusement ride that a physically-disabled person can use to quickly and easily transfer to, or out of, an amusement ride.

All references cited herein are incorporated herein by reference in their entireties.

BRIEF SUMMARY OF THE INVENTION

A passenger transfer device for use with an amusement ride is disclosed. The passenger transfer device comprises: a base portion that forms a seat (e.g., a seat elevated above the height of the seats in the amusement ride) to receive a passenger (e.g., a physically-disabled individual) in a seated position thereon; and an extension that projects from the base portion and is positioned within the amusement ride for receiving the passenger thereon to effect transfer of the passenger into the amusement ride.

A method for assisting a passenger (e.g., a physically-disabled individual) to transfer into (e.g., or out of) an amusement ride is disclosed. The method comprises: placing an elevated seat on a ride platform adjacent the amusement ride; positioning an extension coupled to the elevated seat over a seat in the amusement ride; the passenger positioning himself/herself on the elevated seat; and the passenger sliding himself/herself off of the elevated seat onto the extension and into an open seat in the amusement ride.

BRIEF DESCRIPTION OF SEVERAL VIEWS OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENTS

Figure 1A:
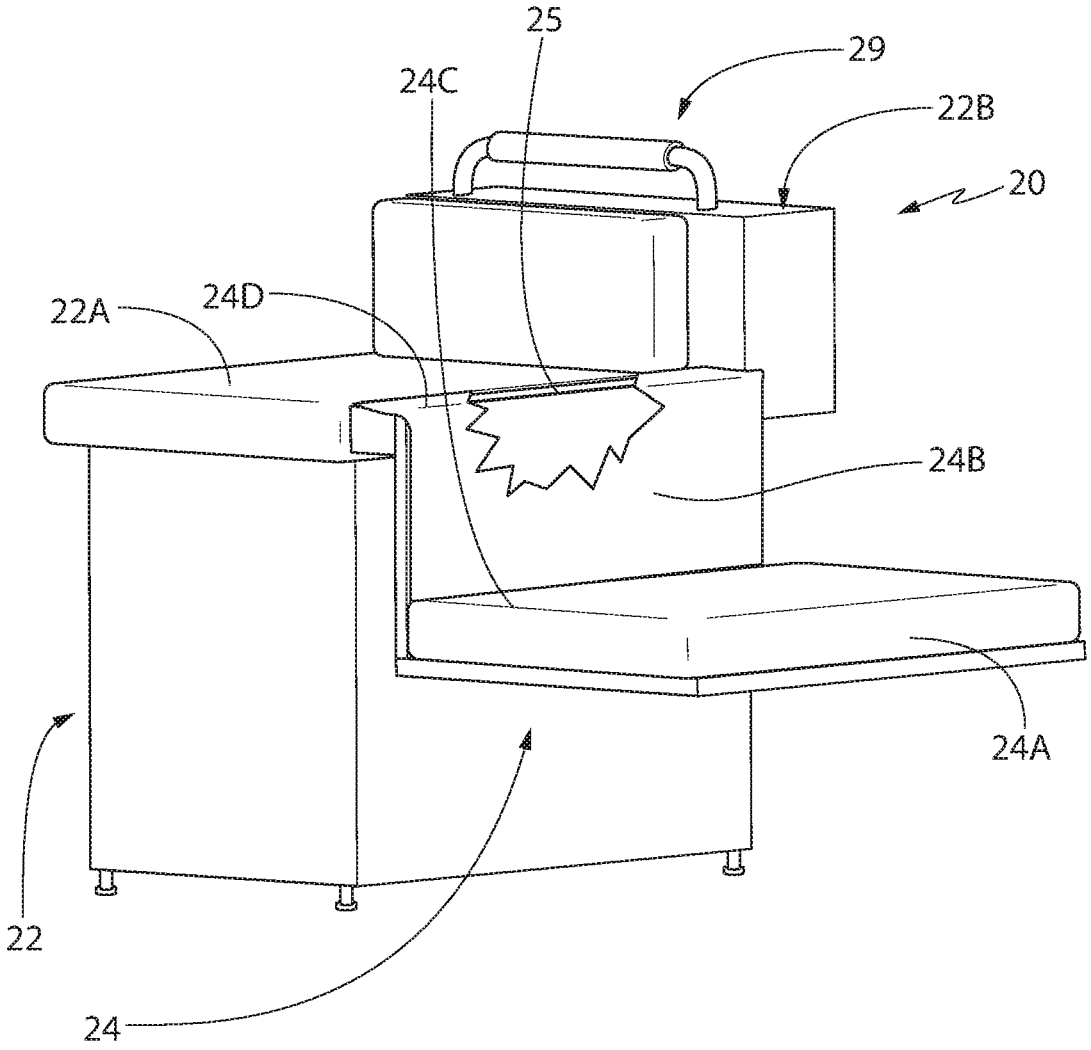
FIG. 1A is an isometric view of the amusement transfer accessibility device for the physically-disabled of the present invention shown in its use condition and with a concealed hinge shown by the break-away.

Referring now to the figures, wherein like reference numerals represent like parts throughout the several views, exemplary embodiments of the present disclosure will be described in detail. Throughout this description, various components may be identified having specific values, these values are provided as exemplary embodiments and should not be limiting of various concepts of the present invention as many comparable sizes and/or values may be implemented.

Figure 1B:
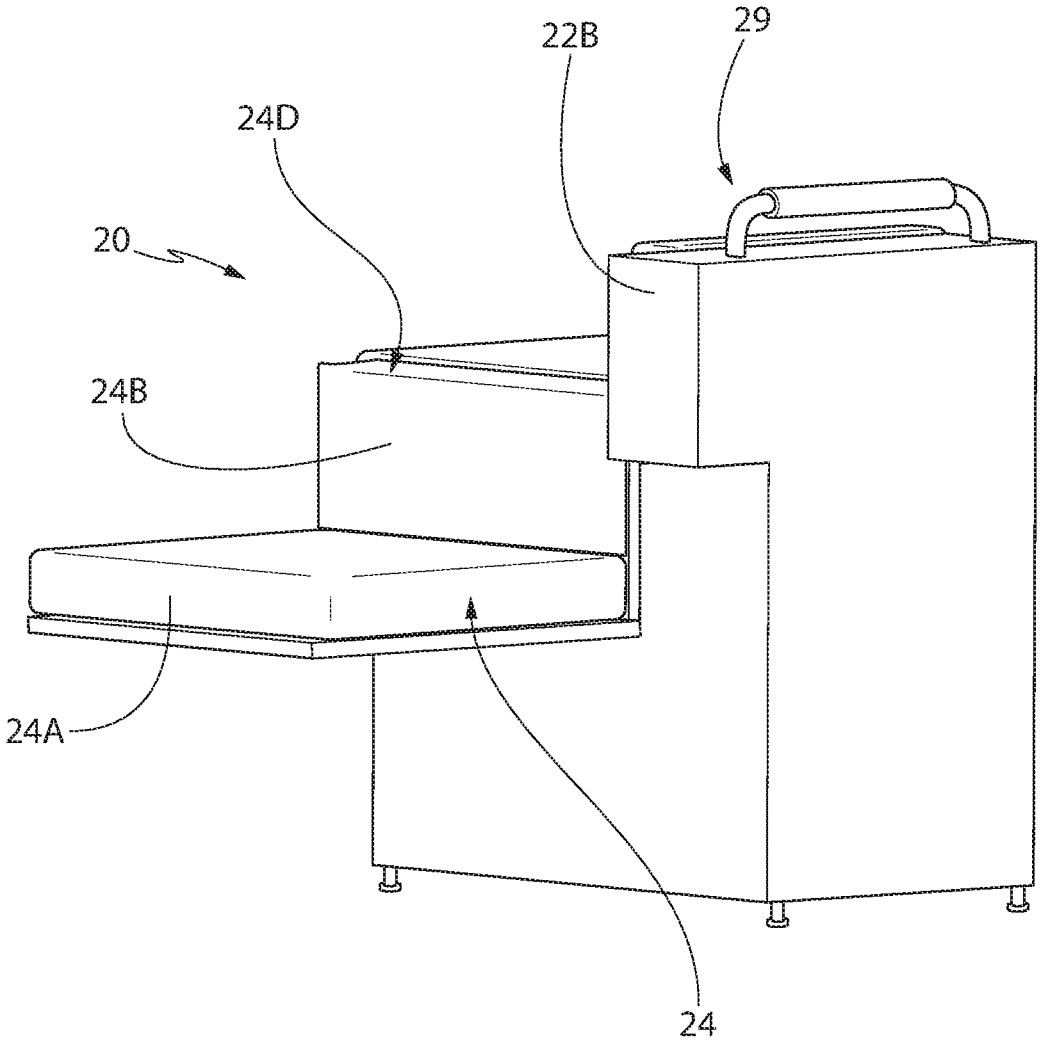
FIG. 1B is an isometric back view of the amusement transfer accessibility device for the physically-disabled of FIG. 1A.
Figure 2:
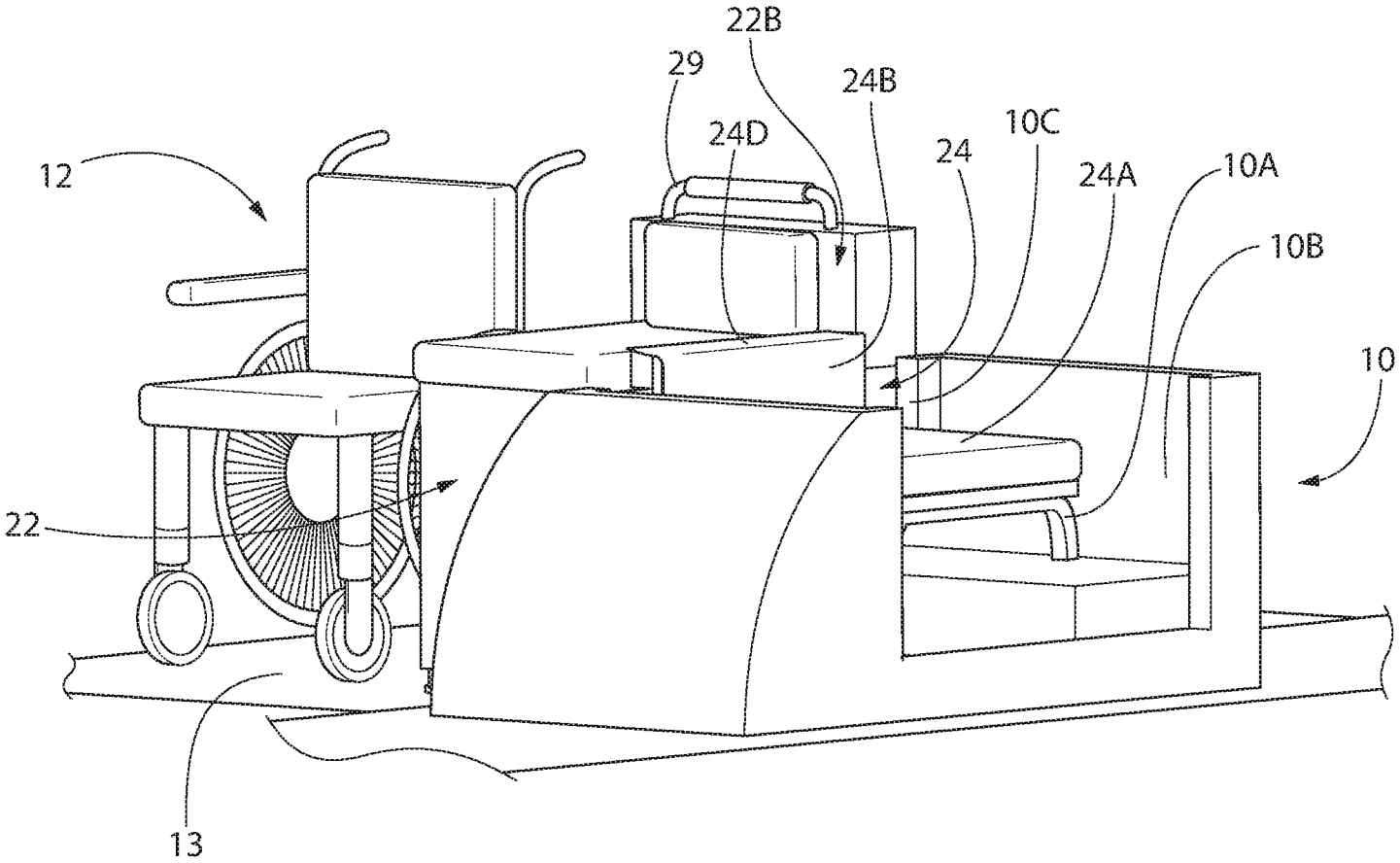
FIG. 2 is an isometric view showing the present invention positioned in place for use adjacent an amusement ride and a wheelchair positioned on the opposite side.

As shown in FIGS. 1A-1B, the amusement transfer accessibility device for the physically-disabled (also referred to as a "passenger transfer device," PTD) 20, comprises a base section 22 having a seat 22A (e.g., cushion) and lower back support 22B (e.g., a cushion) upon which the physically-disabled person (hereinafter "passenger") initially sits upon during the transfer. An "L-shaped" arm 24 projects from one side of the base section 22 and, when the PTD 20 is properly positioned adjacent a particular amusement ride opening, the arm 24 comprises an extension member 24A that overlays an inboard (with respect to the ride platform) seat in the amusement ride 10 (see FIG. 2) and rests upon a seat divider 10A. The extension member 24A is coupled to the base portion 22 via a support member 24B and thus the extension member 24A and support member 24B form the "L-shaped" arm 24. The preferred embodiment of the PTD 20 has the "L-shaped" arm 24 hingedly mounted to the base portion 22, as can easily be seen in FIG. 1A showing a hinge 25. The extension member 24A further comprises a seat 24C (e.g., a cushion). Furthermore, the connection region between the extension member 24A and the base portion 22 is overlaid with a smooth and pliable material 24D (e.g., plastic, leather, cushion, etc.) that provides a soft/gentle transition as the passenger moves from the seat 22A to the seat 24C of the extension member 24A, or vice versa when exiting the amusement ride; furthermore, the pliable material 24D also permits the extension member 24 to be easily folded onto the base portion 22 with minimal obstruction.

Once the passenger has arrived on the seat 24C, the passenger can, with little effort, transfer into the outboard seat 10B (i.e., the seat away from the ride platform) of the amusement ride 10.

Figure 3:
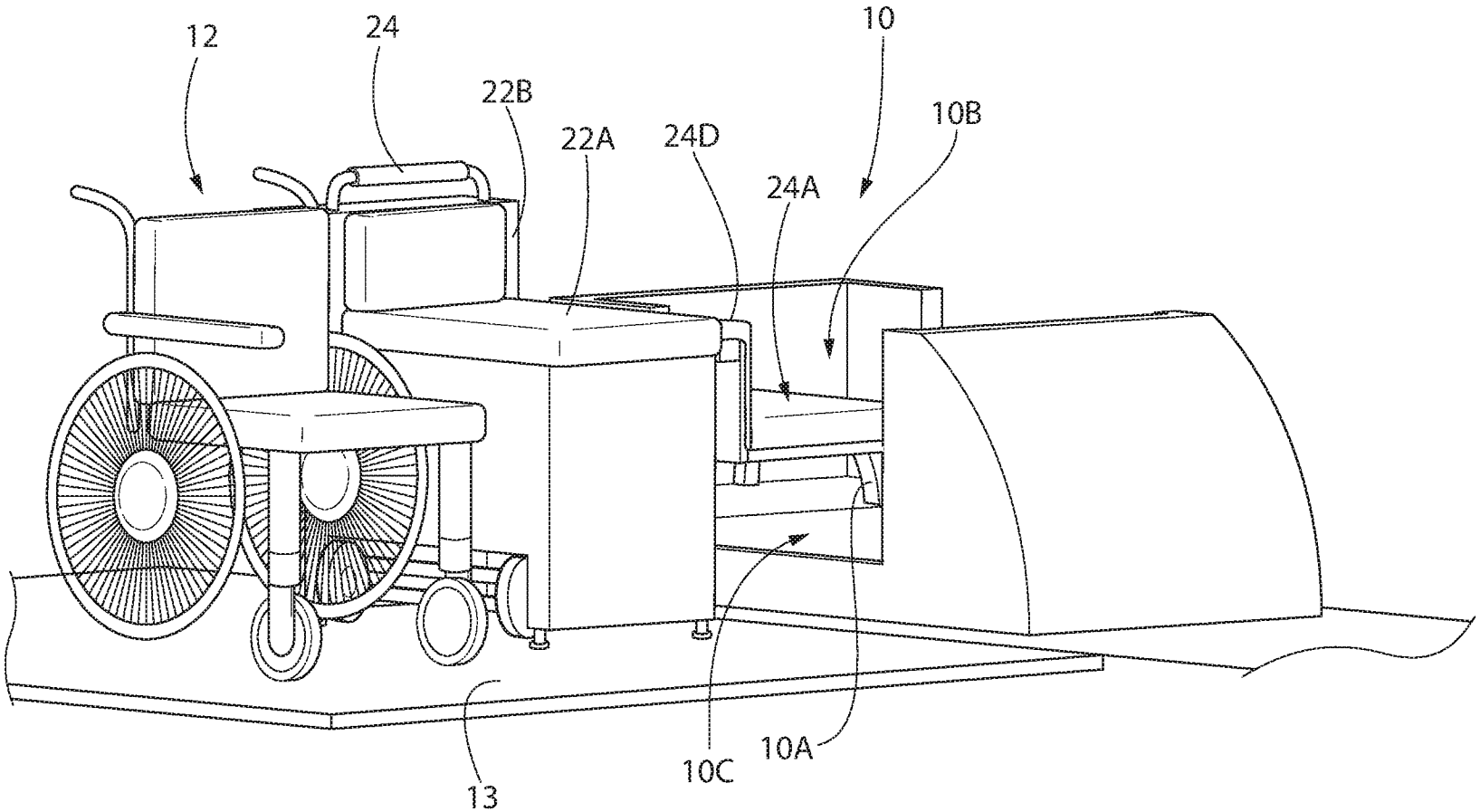
FIG. 3 is another view of the present invention positioned in place.

Once the passenger is properly seated in the amusement ride, the ride operator can fold the extension member 24A up and out of the amusement ride 10 and into a folded position (see FIG. 3). Next, the operator can then move the PTD 20 away from the amusement ride entry 10C (FIG. 3 also) of that particular amusement ride 10 and allow another passenger to enter the inboard seat of the amusement ride 10. It should be noted that the seat 22A is slightly elevated above the height of the seats of amusement ride 10 (see FIG. 1A); this aids in allowing the passenger to move more easily from the seat 22A and onto the extension member 24A and then into the amusement ride seat 10B.

Figure 4:
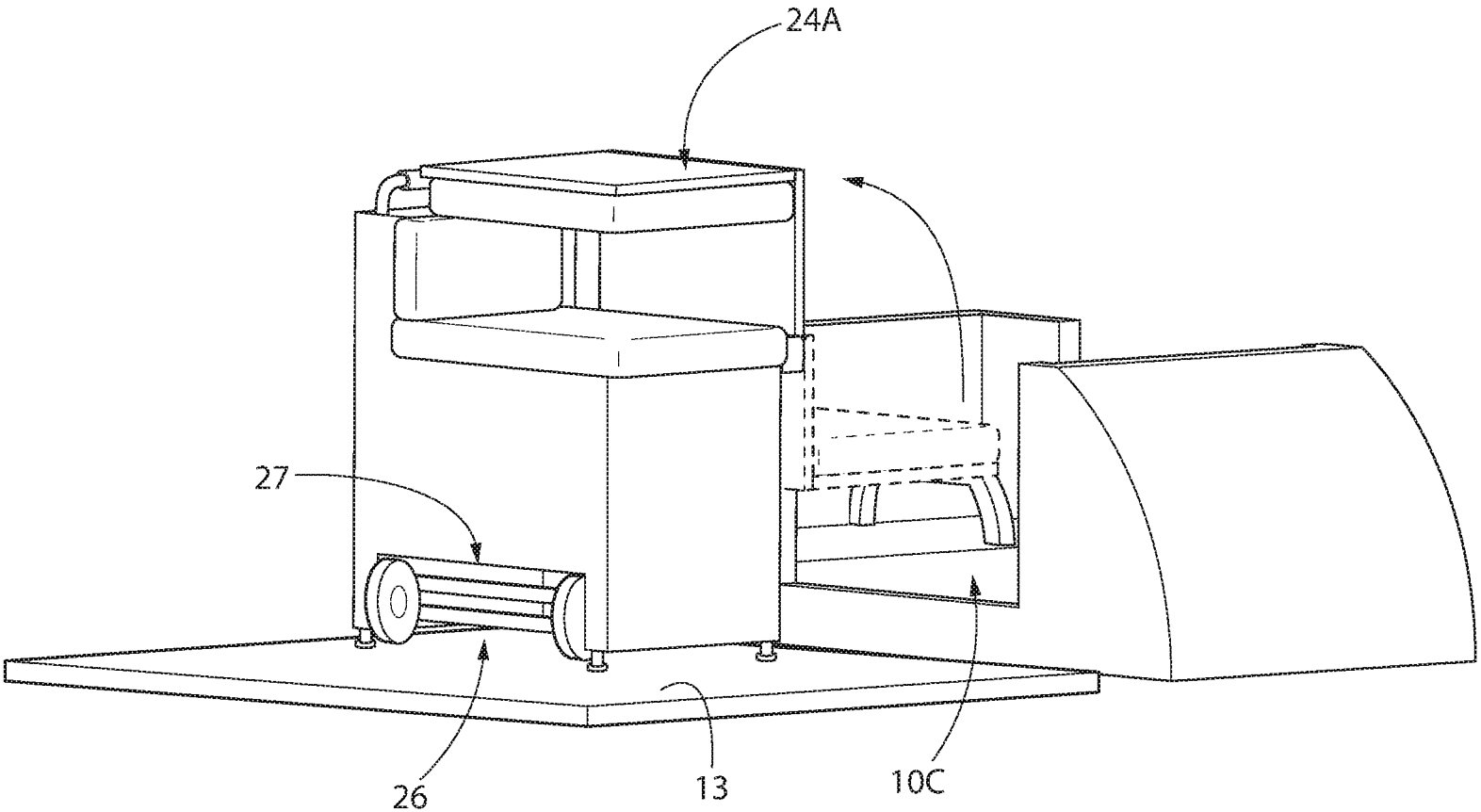
FIG. 4 is a sideview of the present invention shown with the "L-shaped" arm in a folded position.

In view of the foregoing, the PTD 20 is mobile so that it can be used when needed. As such, the PTD 20 may also comprise wheels on a bottom portion of the base portion 22, thereby allowing the operator to move the PTD 20 into, or out of, the proper position on the ride platform 13 next to the desired amusement ride entry point 10C. In particular, as shown most clearly in FIGS. 4/6A, a wheel assembly 26 is positioned along one side of the PTD 20. When in use, the PTD 20 rests on four feet 28A-28D (see FIG. 6B) and the wheel assembly 26 remains out-of-contact with the ride platform 13. These feet 28A-28D prevent the PTD 20 from moving while in use. Furthermore, the wheel assembly 26 is located on the side opposite the side of the PTD 20 that is adjacent the amusement ride 10. As a result, when the PTD 20 is to be moved (see FIG. 7), the operator simply tilts the side of the PTD 20 having the wheel assembly 26 thereon, which is exposed on that side (see cut-away 27), and easily moves the PTD 20 either towards the desired amusement ride opening 10C or away from it when done. A handle 29 is provided on top of the lower back support 22B to assist the operator in maneuvering the PTD 20 when it is tilted onto the wheel assembly 26 during movement. The handle 29 also provides a grip for the passenger to use during transfer to and from the amusement ride 10.

Figure 5:
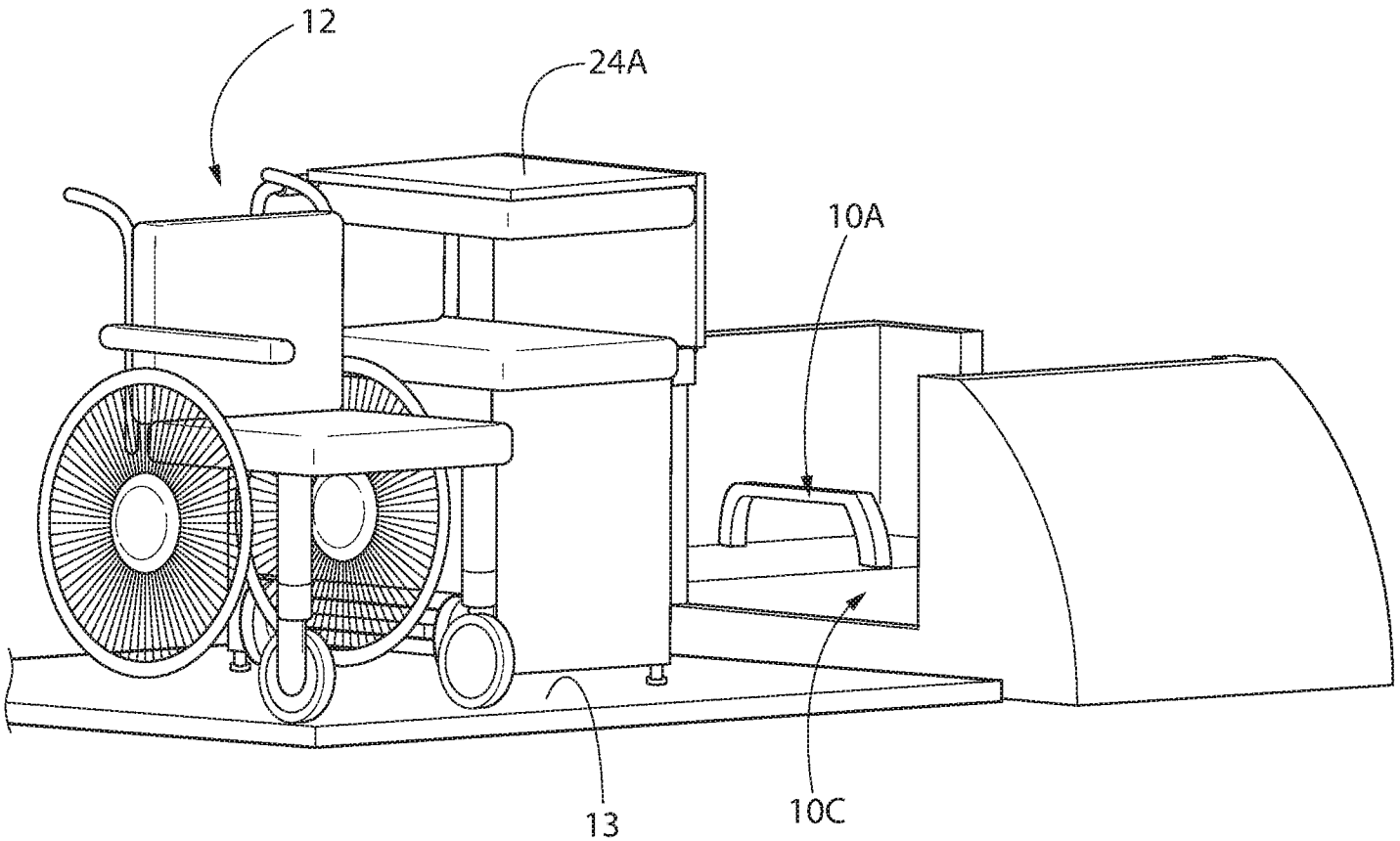
FIG. 5 is an isometric view of the present invention shown in position adjacent the amusement ride on one side and a wheelchair on the other side and with the "L-shaped" arm in a folded position.

By way of example only, when a physically-disabled person (i.e., the passenger) wishes to enter the amusement ride 10, the operator first moves the PTD 20 into position along side of the desired amusement ride entry point 10C (FIG. 3) on the ride platform 13 and tilts the PTD 20 off of the wheel assembly 26 until the PTD 20 rests securely on the four feet 28A-28D. Next, the operator pivots the "L-shaped" arm 24 outwardly until the extension member 24A comes to rest on the seat divider 10A of the amusement ride 10 (see FIGS. 4-5). Once that is completed, the passenger maneuvers his/her wheelchair 12, with the appropriate wheelchair arm rest disengaged (e.g., or lowered, etc.)—see FIG. 3, such that the passenger can pull the wheelchair 12 up close to the base portion of the PTD 20. The passenger then uses his/her upper body to lift himself/herself out of the chair and onto the seat portion 22A. Once seated there, the passenger can then slowly slide over the hinged portion 25 (which is covered by the smooth material 24D) and down onto the extension 24A. Next, the passenger can make one more transfer into the outboard seat 10B of the amusement ride 10. The operator can then fold up the "L-shaped" arm 24 back on top of the base portion 22, tilt the PTD 20 onto its wheel assembly 26 and then move the PTD 20 out of the way and then complete the rest of the amusement ride safety sequence (tightening a harness or safety belt or lap bar restraint over/around the passenger). Similarly, when the amusement ride is complete, the operator again moves the PTD 20 into place alongside the amusement ride 10 having the passenger therein and sets up the PTD 20 as described above but with the passenger now reversing the process to get back into the wheelchair 12. During both entering the amusement ride 10 and departing from it, the passenger can use the handle 29 to facilitate movement onto and off of the PTD 20.

Figure 6A:
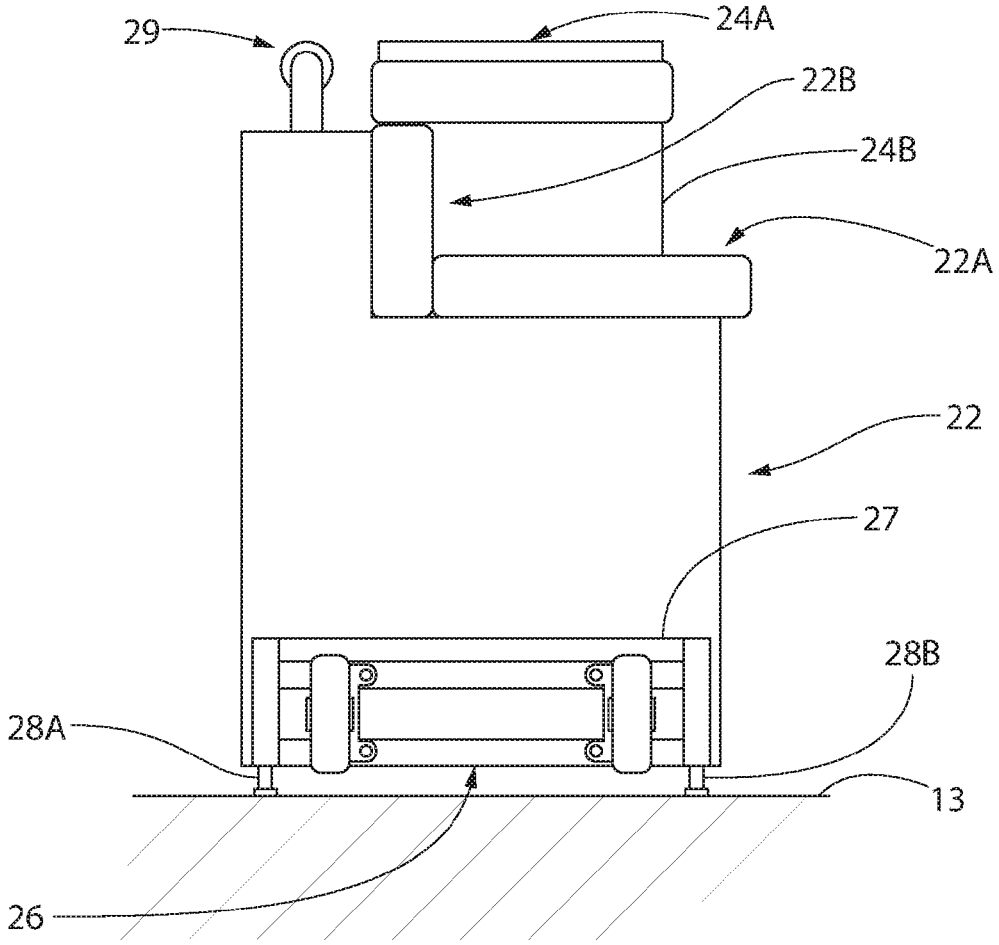
FIG. 6A is a side view of the present invention with the "L-shaped" arm in its folded position and showing the wheel assembly being in a non-contact position with the ground.
Figure 6B:
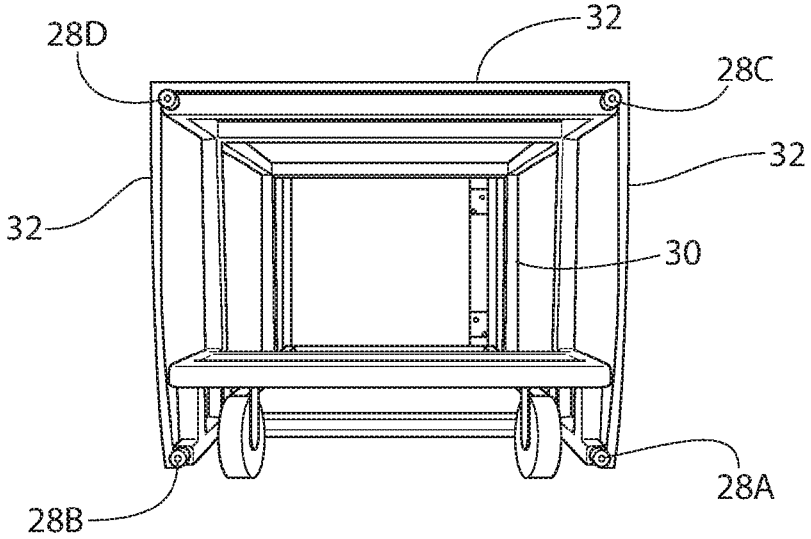
FIG. 6B shows the present invention placed on its side to reveal the internal structure of the base portion.
Figure 7:
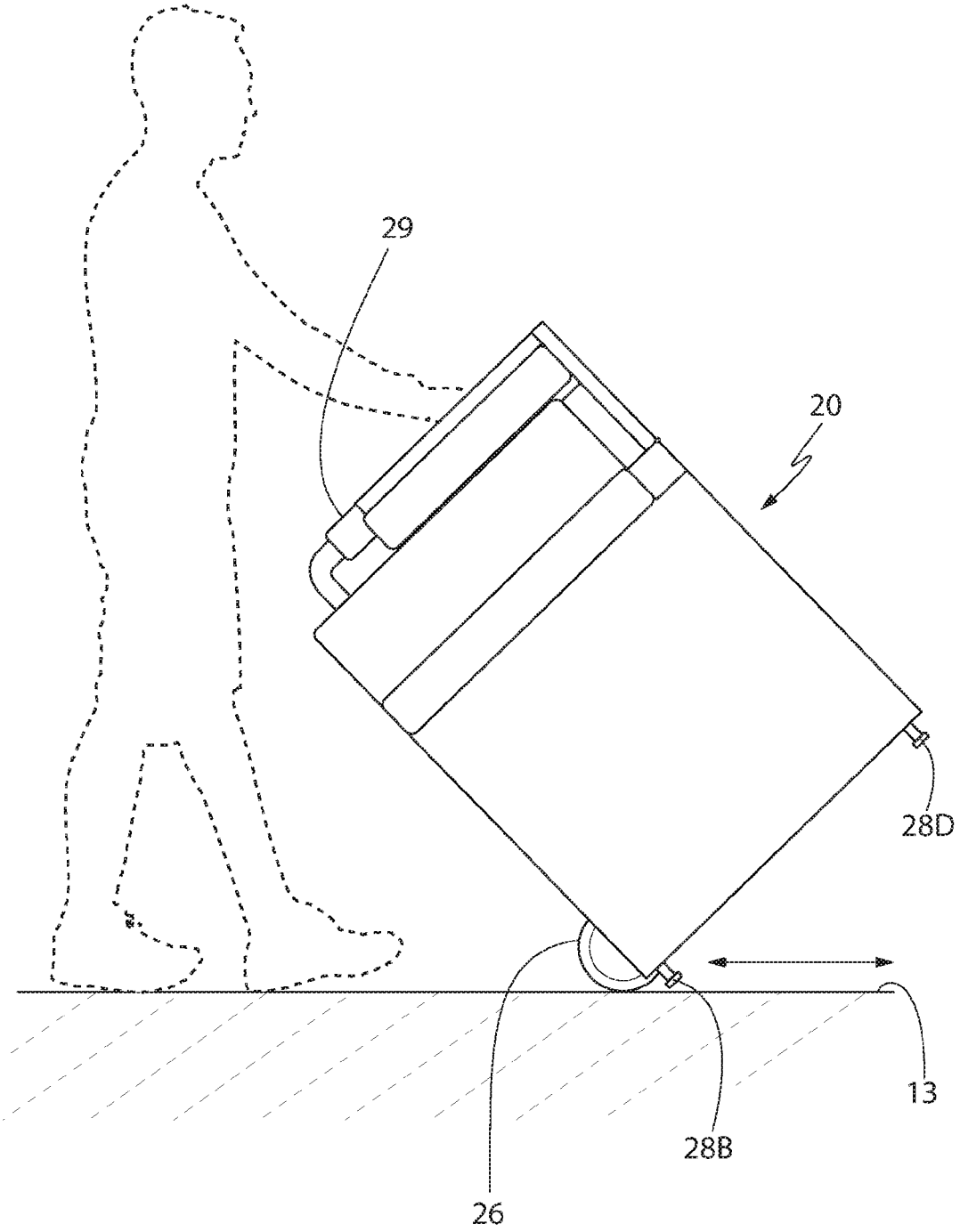
FIG. 7 shows how the present invention is tilted so that it rests on the wheel assembly to allow the present invention to be easily maneuvered into, or away from, the amusement ride.

As shown in FIG. 6B, the PTD 20 comprises a box-like frame 30 formed of rigid members (e.g., steel tubing) covered with panels 32. It should be understood that this construction is by way of example only and that a variety of materials, including plastic, polyvinyl chloride (PVC), and other sheeting could also be used. Furthermore, the PTD 20 could be formed of a unitary material rather than discrete sheets or panels, thereby also reducing the weight of the PTD 20 while maintaining its strength and integrity.

It should be further noted that the figures depict a PTD 20 that is used along the right side of the amusement ride 10. However, this is by way of example only. If the PTD 20 were to be used at the left side of the amusement ride 10, the "L-shaped" arm 24 would be located on the right side of the base section 22 and the wheel assembly 26/cut-away 27 would be located on the left side of the PTD 20.

While the invention has been described in detail and with reference to specific examples thereof, it will be apparent to one skilled in the art that various changes and modifications can be made therein without departing from the spirit and scope thereof.

What is claimed is:

1. A passenger transfer device for use with an amusement ride, said passenger transfer device comprising:

a base portion comprising a seat to receive a passenger in a seated position thereon, said seat fixed to said base portion, said base portion positioned adjacent the amusement ride; and an extension that projects laterally from said base portion and is positioned within the amusement ride for receiving the passenger thereon to effect transfer of the passenger into, or out of, the amusement ride.

2. The passenger transfer device of claim 1 wherein said extension is pivotally coupled to said base portion.

3. The passenger transfer device of claim 2 wherein said extension comprises an "L-shaped" arm.

4. The passenger transfer device of claim 1 further comprising a wheel assembly for making said passenger transfer device mobile.

5. The passenger transfer device of claim 4 wherein said wheel assembly is positioned on only one side of said base portion of said passenger transfer device.

6. The passenger transfer device of claim 1 wherein said base portion forms a box-like configuration having corners and wherein each corner comprises a foot for making said device non-mobile when in use.

7. The passenger transfer device of claim 6 wherein said device comprises a wheel assembly along one side of said box-like configuration, said wheel assembly being displaced off of the ground when said device is positioned on said feet.

8. The passenger transfer device of claim 1 wherein said seat comprises a bottom cushion and a lower back support.

9. The passenger transfer device of claim 8 further comprising a handle positioned on said lower back support.

10. The passenger transfer device of claim 8 wherein said extension is pivotally coupled to said base portion and forms an "L-shaped" arm.

11. The passenger transfer device of claim 10 wherein said L-shaped arm is positioned on said lower back support during transport.

12. The passenger transfer device of claim 11 further comprising a wheel assembly for making said passenger transfer device mobile.

13. The passenger transfer device of claim 12 wherein said wheel assembly is positioned on only one side of said base portion of said passenger transfer device.

14. The passenger transfer device of claim 13 wherein said base portion forms a box-like configuration having corners and wherein each corner comprises a foot for making said device non-mobile when in use.

15. A method for assisting a passenger to transfer into an amusement ride, said method comprising:

placing an elevated seat on a ride platform adjacent the amusement ride;

positioning an extension coupled to said elevated seat over a seat in the amusement ride;

the passenger positioning himself/herself on said elevated seat; and the passenger sliding himself/herself off of said elevated seat onto said extension and into an open seat in the amusement ride.

16. The method of claim 15 wherein said step of positioning an extension comprises positioning a free end of said extension onto a seat divider in the amusement ride.

17. The method of claim 15 wherein said step of placing an elevated seat on a ride platform comprises providing at least one wheel assembly on said elevated seat to permit said elevated seat to be mobile.

18. The method of claim 17 wherein said step of placing an elevated seat on a ride platform further comprises placing feet on a bottom portion of said elevated seat to make said elevated seat non-mobile on the ride platform when said elevated seat is being used and displacing said at least one wheel assembly off of said ride platform.

19. The method of claim 15 wherein said step of positioning an extension coupled to said elevated seat comprises hingedly coupling an "L-shaped arm" to said elevated seat which can be folded outward to be positioned within the amusement ride or folded inward onto said elevated seat during movement of said elevated seat.

20. The method of claim 15 further comprising the steps of assisting a passenger to depart the amusement ride, said steps comprising:

the passenger sliding himself/herself onto said extension;

the passenger moving himself/herself onto said elevated seat from said extension;

the passenger moving himself/herself off of said elevated seat and away therefrom;

removing said extension from within the amusement ride; and displacing said elevated seat and extension away from the amusement ride.

* * * * *